US010615558B2

(12) United States Patent
Malloy et al.

(10) Patent No.: US 10,615,558 B2
(45) Date of Patent: Apr. 7, 2020

(54) RANGE TAKING DIE SET

(71) Applicant: Thomas & Betts International LLC, Wilmington, DE (US)

(72) Inventors: Allen L. Malloy, Memphis, TN (US); Paul J. Bartholomew, Somerville, TN (US); James M. Baker, Southaven, MS (US)

(73) Assignee: Thomas & Betts International LLC, Wilmington, DE (US)

( * ) Notice: Subject to any disclaimer, the term of this patent is extended or adjusted under 35 U.S.C. 154(b) by 408 days.

(21) Appl. No.: 15/404,597

(22) Filed: Jan. 12, 2017

(65) Prior Publication Data

US 2017/0201056 A1 Jul. 13, 2017

Related U.S. Application Data

(60) Provisional application No. 62/278,118, filed on Jan. 13, 2016.

(51) Int. Cl.
*H01R 43/058* (2006.01)
*H01R 43/042* (2006.01)

(52) U.S. Cl.
CPC ..... *H01R 43/058* (2013.01); *H01R 43/042* (2013.01); *H01R 43/0585* (2013.01); *Y10T 29/5327* (2015.01); *Y10T 29/53235* (2015.01)

(58) Field of Classification Search
CPC ..... H01R 43/042; H01R 43/058; H01R 43/0585; Y10T 29/53235; Y10T 29/5327
See application file for complete search history.

(56) References Cited

U.S. PATENT DOCUMENTS

| | | | | |
|---|---|---|---|---|
| 963,394 A | | 7/1910 | Richardson | |
| 2,457,538 A | | 12/1948 | Dupre | |
| 2,639,754 A | | 5/1953 | Macy | |
| 2,692,422 A | | 10/1954 | Pierce | |
| 3,035,627 A | | 5/1962 | Mark | |
| 3,055,412 A | * | 9/1962 | Dibner | H01R 43/058 29/517 |
| 3,706,219 A | * | 12/1972 | Hoffman | H01R 43/042 29/758 |
| 4,048,877 A | | 9/1977 | Undin | |
| 4,080,820 A | | 3/1978 | Allen | |
| 4,132,101 A | | 1/1979 | Abramson | |
| 4,192,171 A | | 3/1980 | Hamilton | |
| 4,199,972 A | | 4/1980 | Wiener | |
| 4,283,933 A | | 8/1981 | Wiener | |
| 4,381,661 A | | 5/1983 | Wiener et al. | |
| 5,722,991 A | | 3/1998 | Colligan | |
| 2001/0002508 A1 | * | 6/2001 | Yamakawa | H01R 43/058 29/753 |

FOREIGN PATENT DOCUMENTS

JP 2015082429 A * 4/2015

* cited by examiner

*Primary Examiner* — A. Dexter Tugbang
(74) *Attorney, Agent, or Firm* — Taft Stettinius & Hollister LLP; J. Bruce Schelkopf

(57) ABSTRACT

A cable compression die assembly is used in connection with a compression tool for compressing a stranded cable prior to crimping. The cable compression die assembly includes a pair of cable compression die heads for receiving a stranded cable and a cable connector therebetween. The pair of cable compression die heads defines a hexagonal shaped opening therebetween and is adapted to substantially close the hexagonal shaped opening as the die heads move towards one another.

15 Claims, 4 Drawing Sheets

RANGE TAKING DIE SET

CROSS-REFERENCE TO RELATED APPLICATIONS

This application claims priority from U.S. provisional application Ser. No. 62/278,118, filed on Jan. 13, 2016, the specification of which is incorporated herein in its entirety for all purposes.

TECHNICAL FIELD

The present invention is directed to crimping wire cables and, more particularly, is directed to an apparatus for radially crimping wire cable strands within an electrical connector.

BACKGROUND

Crimp connections are widely used in industry to connect two electrical conductors or wire cables together. Crimp connections are also used to fasten a ring lug or spade lug to the end of a single cable. The cable or cable pair is inserted into the cable crimp connector, which is then compressed tightly around the cable with a compression tool. With small gauge wire strand cable, the tool is typically manually squeezed to compress the cable connector. In the case of large gauge wire strand cable, the compression tool is typically operated by mechanical leverage or hydraulic pressure.

The compression tool typically has a fixed anvil, (or upper jaw), a movable spindle, (or lower jaw), and a crimping die set, (adapted to the particular wire gauge and connector size), installed in the compression tool. An upper crimp die of the die set is mounted in the upper jaw and a lower crimp die is mounted in the lower jaw. A cable connector is supported in the die set and one or more multi-strand wire cables are received in the cable connector. The lower jaw is raised until the cable connector contacts the upper crimp die until the cable connector is squeezed around the cables.

Die systems use a multitude of individual dies discreetly sized to provide a known amount of compression when closed around the particular connector being compressed. As mentioned above, the die set installed in the compression tool is selected based on the particular gauge of the cable and the size of the connector to be crimped. With this type of system, the dies have to be changed within the compression tool to accommodate different sized connectors. This results in the need for multiple die sets for the compression tool. For example, based on current die sets for both Class A and Class B lugs, all cable sizes from 6 $mm^2$ through 240 $mm^2$ require a single die set for each. This results in the need for a total of 43 die sets for each of the 6 ton and 12 ton tools.

To accommodate a range of crimping sizes, conventional compression tools have been provided in two basic variations: 1) Interchangeable inserts or dies; and 2) Die-less systems. Both compression methods are typically actuated by a tool mounted hydraulic cylinder that closes the compression elements to a predetermined orientation around the connector.

Die-less systems have the ability to adapt the geometry of the compression elements to accommodate different sized connectors without interchanging dies. The disadvantage is the inability to certify the proper compression via die code embossment.

Specifically, industry standards require that each die embosses a discreet code on the connector to allow post compression inspection to verify that the correct die was used. Conventional die sets are hexagonal in shape and have an indenter pin to emboss the required code on the crimped connection. However, current die sets utilizing such indenters create flash and/or sharp edges, which is not acceptable to the end user.

Accordingly, it would be desirable to provide a universal range taking die compression system that is adapted for a range of hexagonal shaped crimp sizes and that further provides the ability to certify the proper compression via die code embossment.

SUMMARY

In one aspect, a cable compression die assembly is used for compressing a stranded cable for subsequent termination in a cable connector. The cable compression die assembly includes a pair of cable compression die heads for directly accommodating the stranded cable therebetween. The die heads are accommodated within a compression tool. The die heads are compressingly closable about the stranded cable by the compression tool. This will reduce spaces between strands of the stranded cable.

In another aspect a cable compression die assembly for compressing a stranded cable in a cable connector includes a pair of cable compression die heads for receiving a stranded cable and a cable connector therebetween. The pair of cable compression die heads defines a hexagonal shaped opening therebetween and is adapted to substantially close the hexagonal shaped opening as the die heads move towards one another.

Each of the cable compression die heads is preferably formed with a plurality of compression legs and a plurality of slots formed between the compression legs. The compression legs of one of the pair of cable compression die heads are received within the slots of the other of the pair of cable compression die heads.

Each of the cable compression die heads is further preferably formed with a base section, wherein the plurality of compression legs extends upwardly from the base section in parallel planar pairs. The base section and the compression legs are formed with compression surfaces, wherein the compression surfaces of each pair of compression legs together with the compression surface of an immediately adjacent base section define a semi-hexagonal profile.

In a preferred embodiment, the plurality of compression legs have a height measured from the base section compression surface in a first direction and the slots have a depth measured from the base section compression surface in a second direction opposite the first direction. The depth of the slots is equal to or greater than the height of the compression legs so that the base section compression surfaces of the opposite die heads can make contact.

At least one of the cable compression die heads preferably includes a raised portion, termed an indenter, which extends partially into the hexagonal shaped opening. The indenter may be an integral portion of the die head, or it may be removable from the die head. In either case, the indenter preferably has a length substantially equal to a thickness of the die head.

The hexagonal opening formed between the opposite die heads defines a central axis. Upon assembling the die assembly, the compression die heads are displaced from each other in a direction of the central axis a distance equal to a distance between adjacent slots so that the legs of one die head can be received within the slots of the opposite die head.

These and other aspects, objectives, features, and advantages of the disclosed technologies will become apparent from the following detailed description of illustrative embodiments thereof, which is to be read in connection with the accompanying drawings.

DETAILED DESCRIPTION

Figure 1:
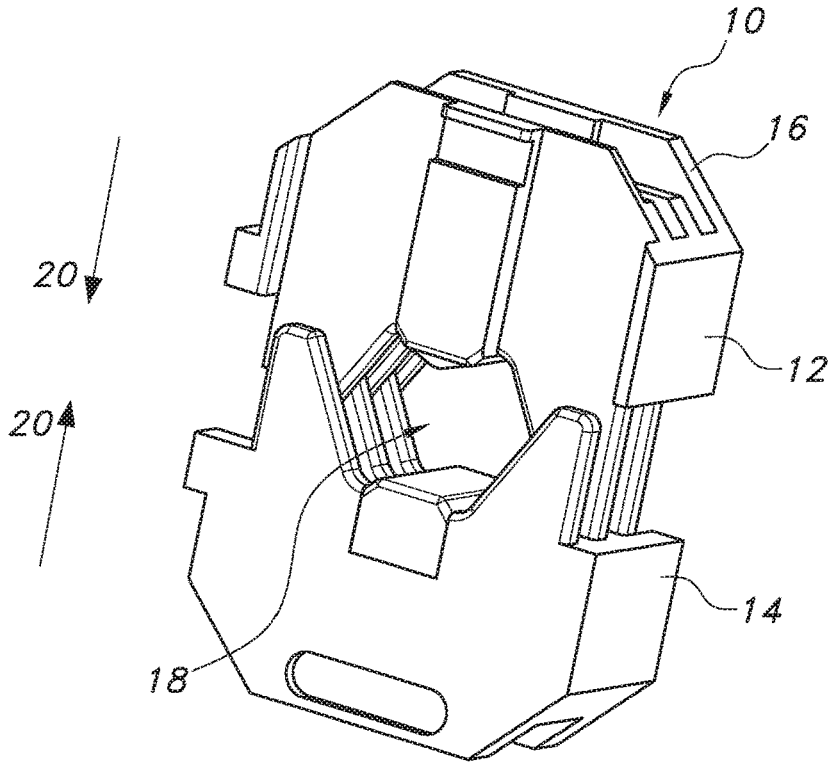
FIG. 1 is a perspective view of the compression die assembly formed in accordance with the present invention in an open position.
Figure 2:
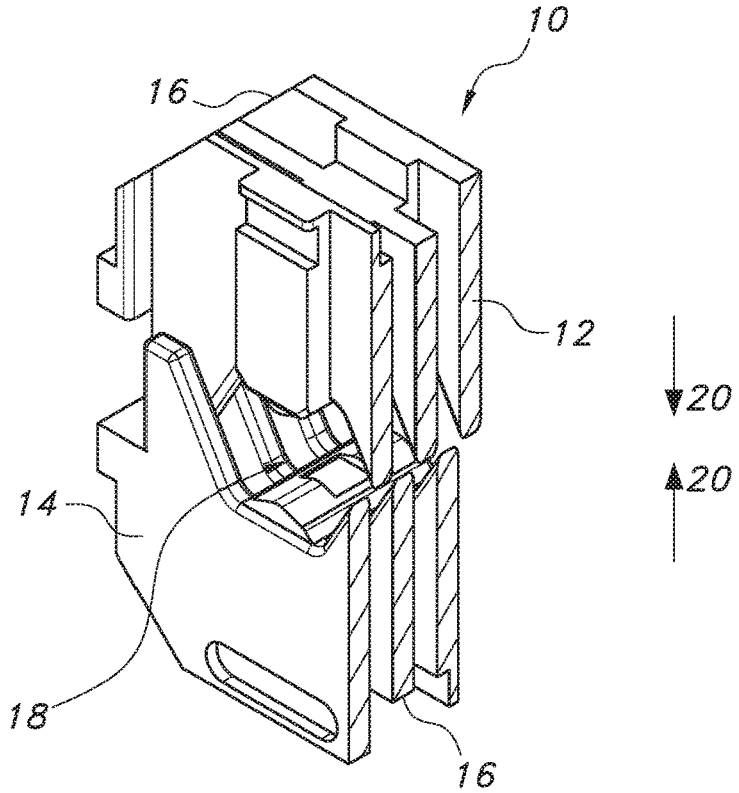
FIG. 2 is a perspective cross-sectional view of the compression die assembly of FIG. 1.
Figure 3:
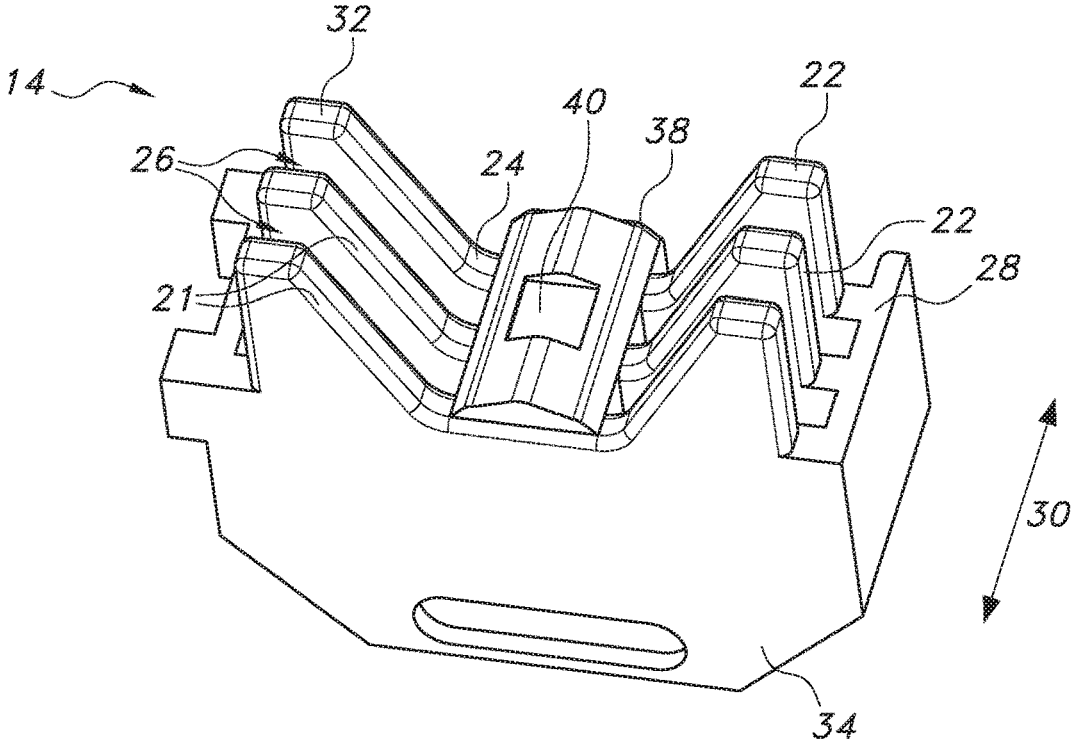
FIG. 3 is an isolated perspective view of one of the die heads of the compression die assembly shown in FIGS. 1 and 2.
Figure 4:
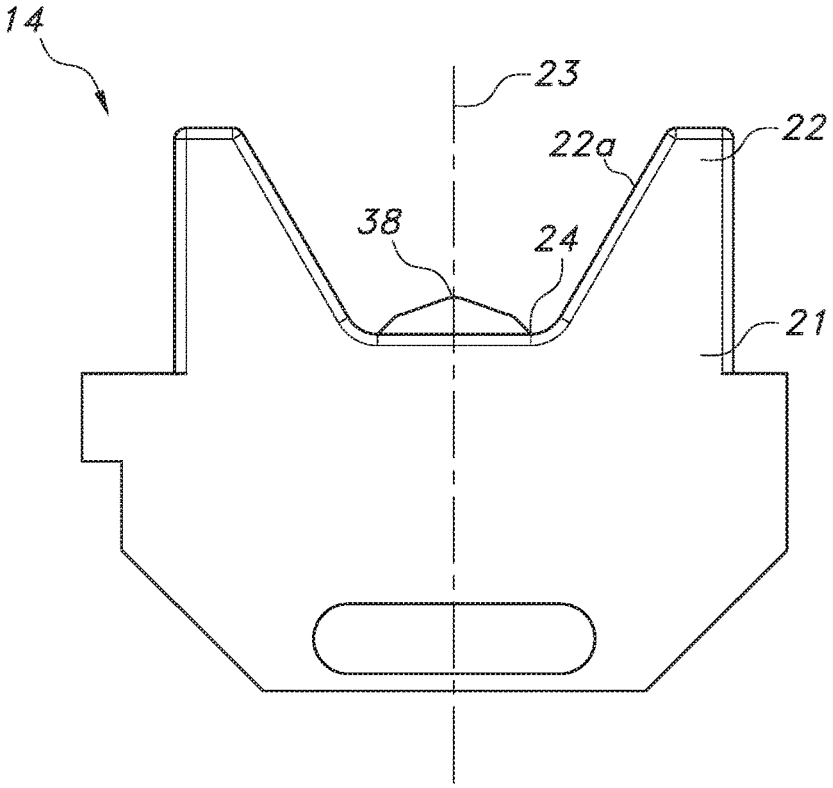
FIG. 4 is a front plan view of the die head shown in FIG. 3.
Figure 5:
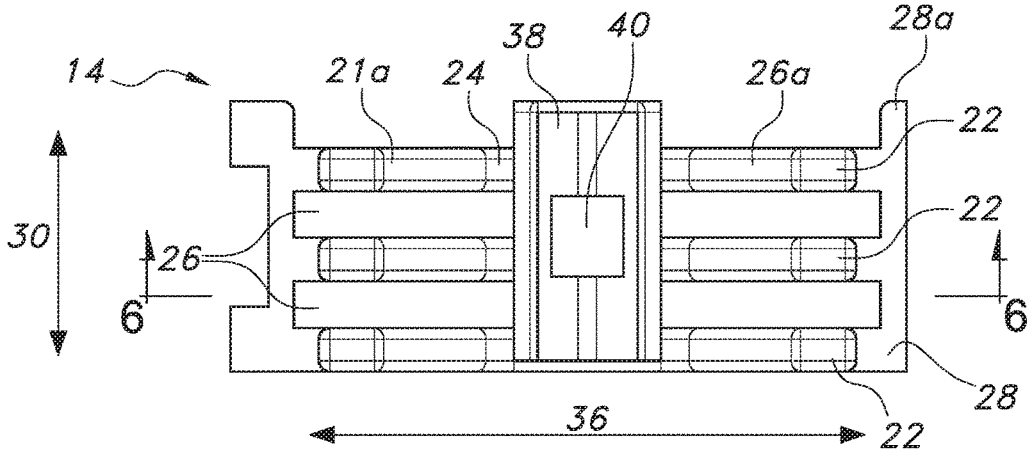
FIG. 5 is a top plan view of the die head shown in FIGS. 3 and 4.
Figure 6:
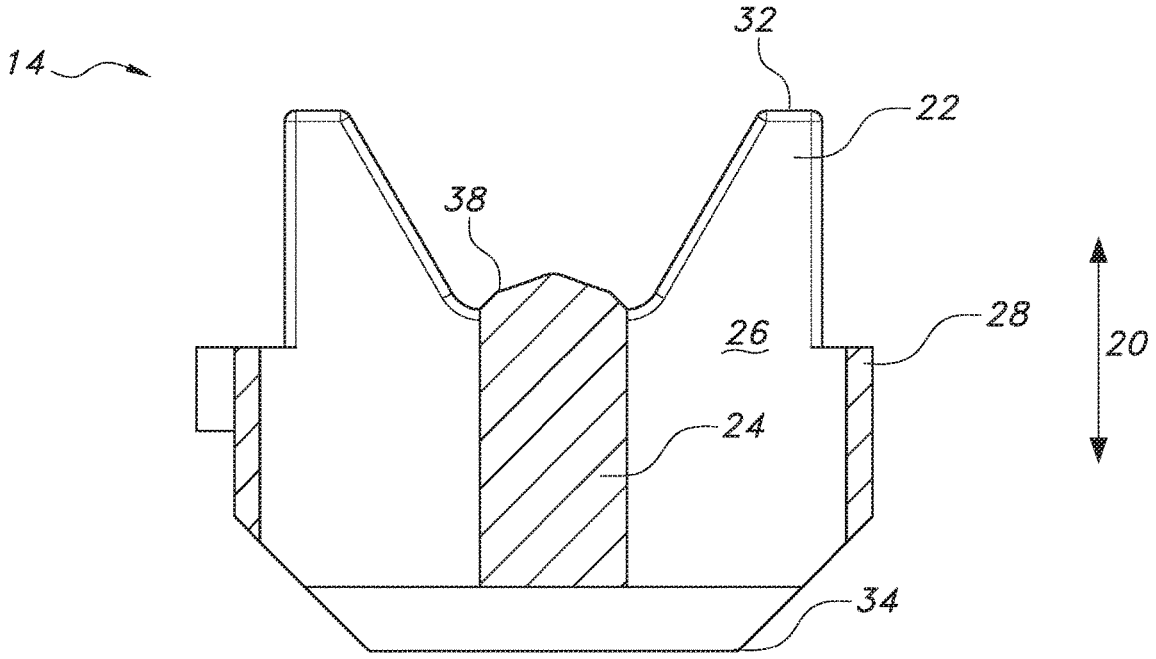
FIG. 6 is a cross-sectional view of the die head shown in FIGS. 3, 4 and 5 taken along line 6-6 of FIG. 5.

Describing now in further detail these exemplary embodiments, the present invention employs a compression tool (not shown in the drawings) to compress stranded cable (not shown) using a cable compression die assembly 10, as shown in FIGS. 1 and 2. Specifically, the compression tool is used to terminate a connector (not shown) to the compressed cable using the cable compression die assembly to form a superior connection between the cable and the connector.

The compression tool has an upper jaw and a lower jaw adapted for moving toward one another. The cable compression die assembly 10, according to the present invention, includes an upper compression die head 12, which is received in the upper jaw of the compression tool, and a lower compression die head 14, which is received in the lower jaw of the compression tool. The upper and lower compression die heads 12, 14 may be provided with mounting grooves 16, or other structure for positively locating and fixing the die heads to their respective compression tool jaws.

The upper and lower die heads 12, 14 are identical in most respects. The crimping side of each die 12, 14 defines a semi-hexagonal profile so that, when facing each other, the die heads together form a hexagonal shaped opening 18 for receiving the cable connector. Upon moving the upper and lower jaws of the compression tool together, the upper compression die head 12 and the lower compression die head 14 will move toward one another in a closing direction 20, which will decrease the size of the hexagonal opening 18 formed between the die heads 12, 14. As a result, the cable and connector received within the hexagonal opening 18 will be compressed between the die heads 12, 14.

FIGS. 3-6 show a lower compression die head 14 in isolation. However, as mentioned above, the upper and lower die heads 12, 14 are essentially identical, so that the description set forth below with respect to the lower die head 14 applies equally to the upper die head 12, as shown in FIGS. 1 and 2.

The die head 14 includes a plurality of parallel plates 21 connected to one another in a spaced manner in an axial direction 30. Each plate 21 has two guide fingers 22 extending upward and outwardly from a base section 24 of the die head. The guide fingers 22 are thus centrally connected to one another by the base section 24. The guide fingers 22 of each plate 21 are mirror symmetrical about a die head centerline 23 and have compression surfaces 22*a* facing the centerline at an acute angle with respect to the centerline. As such, the guide fingers 22 and the base section 24 of each plate 21 define the semi-hexagonal profile of the die head 14.

The common base section 24 of the die head 14 connects the parallel plates 21 together. For strength and structural purposes, the plates 21 are also connected to one another at their outer radial edges by side walls 28. The side walls 28 together form a web that spans all of the plates 21 in the axial direction 30.

The parallel plates 21 are separated from one another by slots 26. The slots 26 are provided in pairs in the axial direction and are symmetric with respect to the die head centerline 23. Thus, each slot 26 is formed between a pair of adjacent plates 21 in the axial direction 30 and between the base section 24 and an opposite side wall 28 in the lateral or radial direction 36 perpendicular to the axial direction.

The slots 26 have a width in the axial direction 30 generally equal to, but slightly greater than the thickness of the fingers 22 of each plate 21 in the axial direction. As will be discussed in further detail below, such dimensions allow the fingers 22 of the upper compression die head 12 to be received within the slots 26 of the lower compression die head 14, and vice versa, with little axial clearance space between the fingers and the slots.

The slots 26 have a depth that extends the entire height of the plates 21 in the direction of the centerline 23 of the die head 14. In other words, the slots 26 extend in the closing direction 20 from the ends 32 of the fingers 22 and open at the bottom 34 of the head 14. For structural purposes, the slots 26 are bounded in the radial direction 36 by the side walls 28 so that they do not extend the full width of the head 14. As such, the slots 26 form openings that extend through the height of the entire die head 14 when viewing the die head in the closing direction 20.

A pair of so called half-slots 26*a* is also provided on one of the axial faces of the die head 14. Each half-slot 26*a* is formed as a recess defined in the axial direction by an outermost plate 21*a* and in the radial direction by a side wall 28*a* and the base section 24 extending in the axial direction 30 from the outermost plate. This half-slot 26*a* is not bounded in the axial direction opposite its bottom surface. As will be described in further detail below, the half-slot 26*a* allows for one of the identical die heads to be used as an upper die head and another to be used as a lower die head by simply inverting and axially displacing one die head with respect to the other.

By forming slots 26 that extend through the entirety of the die head 14, the fingers 22 of the opposite die head 12 are permitted to travel a greater distance, as compared with prior art die heads. The height of the side walls 28 in the closing direction 20 is also chosen to ensure that the die heads 12, 14 will be able to completely close the hexagonal opening 18 formed between the die heads, thereby accommodating a full range of cable and connector sizes. This can be achieved by forming the side walls 28 with a height, as measured from the bottom 34 of the die head 14, that is less than the height of the base section 24, as measured from the same point. This full closure of the hexagonal opening 18 further eliminates sharp edges and flash, which typically occurs when the die heads are forced to stop movement toward each other during a compression cycle.

Each die head 12, 14 may further include an indenter 38. In one embodiment, the indenter 38 is an integral raised portion of the base section 24 that extends into the semi-hexagonal profile defined by the legs 22 of the parallel plates 21 and the base section. The indenter 38 preferably extends in the axial direction 30 the full width of the die head 14. The indenter 38 may also include one or more structural features 40, such as recesses or protrusions, formed in its embossing surface to impart a particular symbol or code into the crimped connector when the die heads are brought together.

Figure 7:
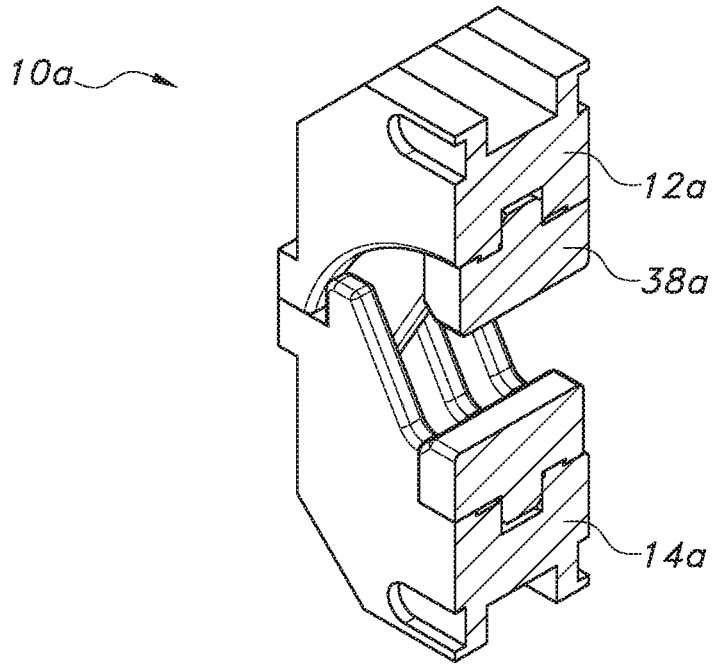
FIG. 7 is a perspective cross-sectional view of an alternative embodiment of a compression die assembly formed in accordance with the present invention.
Figure 8:
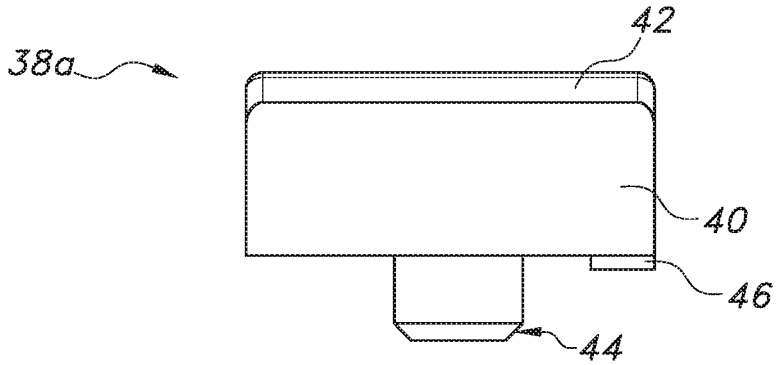
FIG. 8 is an isolated side plan view of the indenter insert shown in FIG. 7.
Figure 9:
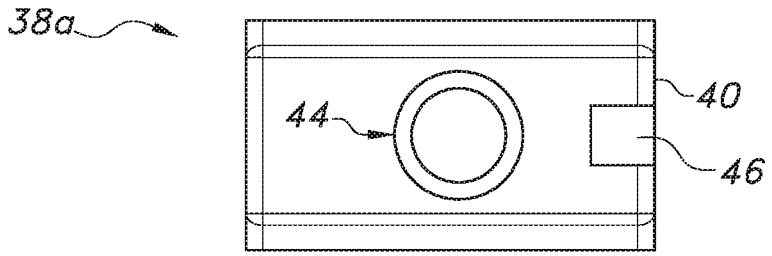
FIG. 9 is a bottom plan view of the indenter insert shown in FIGS. 7 and 8.

In an alternative embodiment, as shown in FIGS. 7-9, the indenter 38*a* is provided as a separate piece that can be assembled to the base section of the die head 12*a*, 14*a*. For example, the indenter 38*a* may include an indenter body 40 defining an embossing surface 42, and having a pin 44 extending outwardly from a bottom of the body opposite the embossing surface. The pin 44 is received in a correspondingly sized hole provided in the base section of the die head 12, 14. Fixing of the indenter 38*a* can be achieved via a press fit between the pin 44 and the hole, or via one or more suitable screws or other fasteners.

A locating protrusion 46 may also be formed on the bottom surface of the indenter 38*a* opposite the embossing surface. This protrusion 46 may take any shape and is received in a correspondingly shaped recess provided in the base section of the die head 12, 14 to provide proper orientation of the indenter with respect to the die head.

As described above, the indenter 38, 38*a* is provided to emboss a marking on the cable connector for inspection purposes. Specifically, as the die heads 12, 14 are brought together, the indenter 38, 38*a* presses into the relatively more ductile material of the connector, thereby leaving an impression in the connector.

In the preferred embodiment shown, the upper and lower compression dies 12, 14 are identical to one another, but are displaced with respect to each other in the axial direction 28 a distance equal to the width of the slots 26, when fixed within the compression tool. In this manner, the fingers 22 of the upper die head 12 can be received within the slots 26 of the lower die head 14, and vice versa. As described above, one of the outer most plates 21 in the axial direction 30 of one die head 12 is received in the half-slot 26*a* of the other die head 14.

Furthermore, the die assembly 10 can be oriented in any direction. The preferred embodiment shows a vertical orientation with the compression tool upper jaw at the top and the lower jaw at the bottom. It is to be understood that the compression tool and the die assembly 10 and the upper and lower compression die heads 12, 14 can be oriented in any position, vertical, horizontal, angled, the upper and lower portions reversed, and that these orientations are equivalent within the spirit and scope of the claims.

It will be appreciated that variants of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

It should be apparent to those skilled in the art that the described embodiments of the present invention provided herein are illustrative only and not limiting, having been presented by way of example only. As described herein, all features disclosed in this description may be replaced by alternative features serving the same or similar purpose, unless expressly stated otherwise. Therefore, numerous other embodiments of the modifications thereof are contemplated as falling within the scope of the present invention as defined herein and equivalents thereto. While various embodiments of the present invention are specifically illustrated and/or described herein, it will be appreciated that modifications and variations of the present invention may be effected by those skilled in the art without departing from the spirit and intended scope of the invention.

All documents, patents and other literature referred to herein are incorporated by reference in their entirety.

The term "comprising" as may be used in the following claims is an open-ended transitional term that is intended to include additional elements not specifically recited in the claims. The term "consisting essentially of" as may be used in the following claims is a partially closed transitional phrase and is intended to include the recited elements plus any unspecified elements that do not materially affect the basic and novel characteristics of the claims. For example, the cable tie may be embossed or printed with indicia and still be included in the meaning of "consisting essentially of", even if not specifically recited. The term "consisting of" as may be used in the following claims is intended to indicate that the claims are restricted to the recited elements.

It should be noted that it is envisioned that any feature, element or limitation that is positively identified in this document may also be specifically excluded as a feature, element or limitation of an embodiment of the present invention.

What is claimed is:

1. A cable compression die assembly for compressing a stranded cable in a cable connector, the cable compression die assembly comprising a pair of cable compression die heads for receiving the stranded cable and the cable connector between the pair of cable compression die heads, wherein said pair of cable compression die heads define a hexagonal shaped opening between the pair of compression die heads, and wherein said pair of cable compression die heads are adapted to substantially close said hexagonal shaped opening as said pair of compression die heads move towards one another, wherein:

each of said pair of cable compression die heads comprises a plurality of compression legs and a plurality of slots formed between said compression legs, the compression legs of one of said pair of cable compression die heads being received within the slots of the other of said pair of cable compression die heads; and each of said plurality of slots opens at a bottom end of each of said pair of cable compression die heads to form an opening that extends a full height of each of said pair of cable compression die heads.

2. A cable compression die assembly as defined in claim 1, wherein each of said pair of cable compression die heads comprises a pair of sidewalls that bound said plurality of slots of each of the pair of compression die heads so that said plurality of slots do not extend a full width of each of said pair of cable compression die heads.

3. A cable compression die assembly as defined in claim 1, wherein said hexagonal shaped opening defines a central axis, and wherein said pair of compression die heads are displaced from each other in a direction of said central axis a distance equal to a distance between adjacent slots of the plurality of slots.

4. A cable compression die assembly as defined in claim 1, wherein each of said pair of cable compression die heads further comprises a base section, said plurality of compression legs extending upwardly from said base section in parallel planar pairs.

5. A cable compression die assembly as defined in claim 4, wherein said base section and said plurality of compression legs comprise compression surfaces, the compression surfaces of each of the plurality of compression legs together with the compression surface of the base section that is immediately adjacent to the compression surfaces of the plurality of compression legs defining a semi-hexagonal profile.

6. A cable compression die assembly as defined in claim 5, wherein said plurality of compression legs have a height measured from said compression surface of the base section in a first direction and said plurality of slots have a depth measured from said compression surface of the base section in a second direction opposite said first direction, said depth of said plurality of slots being equal to or greater than said height of said plurality of compression legs.

7. A cable compression die assembly as defined in claim 1, wherein at least one of said pair of cable compression die heads comprises an indenter, said indenter being a raised portion extending partially into said hexagonal shaped opening.

8. A cable compression die assembly as defined in claim 7, wherein said indenter is an integral portion of said at least one of the pair of compression die heads.

9. A cable compression die assembly as defined in claim 7, wherein said indenter is removable from said at least one of the pair of compression die heads.

10. A cable compression die assembly as defined in claim 7, wherein said indenter has a length substantially equal to a thickness of said at least one of the pair of compression die heads.

11. A cable compression die assembly as defined in claim 7, wherein each of said pair of cable compression die heads comprises a pair of sidewalls that bound said plurality of slots of each of the pair of compression die heads so that said plurality of slots do not extend a full width of each of said pair of cable compression die heads.

12. A cable compression die assembly as defined in claim 7, wherein said hexagonal shaped opening defines a central axis, and wherein said pair of compression die heads are displaced from each other in a direction of said central axis a distance equal to a distance between adjacent slots of the plurality of slots.

13. A cable compression die assembly as defined in claim 7, wherein each of said pair of cable compression die heads further comprises a base section, said plurality of compression legs extending upwardly from said base section in parallel planar pairs, and said indenter being a raised portion of said base section extending partially into said hexagonal shaped opening.

14. A cable compression die assembly as defined in claim 13, wherein said base section and said plurality of compression legs comprise compression surfaces, the compression surfaces of each of the plurality of compression legs together with the compression surface of the base section that is immediately adjacent to the compression surfaces of the plurality of compression legs defining a semi-hexagonal profile.

15. A cable compression die assembly as defined in claim 14, wherein said plurality of compression legs have a height measured from said compression surface of the base section in a first direction and said plurality of slots have a depth measured from said compression surface of the base section in a second direction opposite said first direction, said depth of said plurality of slots being equal to or greater than said height of said plurality of compression legs.

* * * * *